US009458595B2

(12) United States Patent
Mohrfeld

(10) Patent No.: US 9,458,595 B2
(45) **Date of Patent: *Oct. 4, 2016**

(54) HEAVY DUTY VENT CAP SYSTEM FOR A SUCTION PILE

(71) Applicant: Austin Mohrfeld, Tomball, TX (US)

(72) Inventor: Austin Mohrfeld, Tomball, TX (US)

( * ) Notice: Subject to any disclaimer, the term of this patent is extended or adjusted under 35 U.S.C. 154(b) by 63 days.

This patent is subject to a terminal disclaimer.

(21) Appl. No.: 14/498,927

(22) Filed: Sep. 26, 2014

(65) Prior Publication Data

US 2016/0090709 A1 Mar. 31, 2016

(51) Int. Cl.

| | |
|---|---|
| ***B63B 21/27*** | (2006.01) |
| ***B63B 35/44*** | (2006.01) |
| ***E02D 31/10*** | (2006.01) |
| ***E02D 27/52*** | (2006.01) |

(52) U.S. Cl.

CPC ..... *E02D 31/10* (2013.01); *B63B 21/27* (2013.01); *B63B 35/4413* (2013.01); *E02D 27/525* (2013.01)

(58) Field of Classification Search

CPC ..... E02D 27/52; E02D 27/525; E02D 2250/0053; B63B 21/27

USPC ..... 405/224.1; 114/296

See application file for complete search history.

(56) References Cited

U.S. PATENT DOCUMENTS

| | | | | |
|---|---|---|---|---|
| 3,817,040 | A * | 6/1974 | Stevens | E02D 7/24 114/295 |
| 6,122,847 | A | 9/2000 | Treu et al. | |
| 6,322,439 | B1 | 11/2001 | David | |
| 6,719,496 | B1 | 4/2004 | Von Eberstein | |
| 7,621,059 | B2 * | 11/2009 | McCoy, Jr. | E02F 3/905 114/296 |
| 7,661,905 | B2 * | 2/2010 | Alhayari | B63B 21/27 114/296 |
| 8,021,082 | B2 | 9/2011 | Thomas et al. | |
| 9,221,522 | B2 * | 12/2015 | Mohrfeld | B63B 21/27 |
| 2006/0127187 | A1 | 6/2006 | Raines et al. | |
| 2007/0140796 | A1 * | 6/2007 | Alhayari | B63B 21/27 405/224.1 |
| 2008/0292409 | A1 | 11/2008 | Alhayari | |
| 2009/0297276 | A1 | 12/2009 | Foo et al. | |
| 2012/0006557 | A1 | 1/2012 | Fraser et al. | |
| 2012/0024535 | A1 | 2/2012 | Lieske, II | |
| 2013/0220206 | A1 | 8/2013 | Mogedal et al. | |
| 2015/0191220 | A1 * | 7/2015 | Mohrfield | B63B 21/27 114/296 |

FOREIGN PATENT DOCUMENTS

| | | | | |
|---|---|---|---|---|
| NO | WO 2015043856 | A1 * | 4/2015 | B63B 21/27 |

* cited by examiner

*Primary Examiner* — Frederick L Lagman

(74) *Attorney, Agent, or Firm* — Andrew W. Chu; Craft Chu PLLC

(57) ABSTRACT

The heavy duty a vent cap system includes a top plate with a bucket interface, a center stem assembly, a retainer assembly, a bottom plate with a stem sleeve and guiding device, an adapter ring, a plurality of perimeter stem assemblies and a plurality of perimeter installation stems. A remote operated vehicle engages the bucket interface to rotate a center stem member in the center stem assembly. A threaded portion of the center stem assembly engages a stem nut in the retainer assembly. The rotation along threads of the stem nut held within the retainer assembly actuates the bottom plate between opened and closed positions. The bottom plate maintains alignment to the top plate and adapter ring and resists cocking and distortion. The bottom plate seals to a connection portion of the adapter ring in any orientation of the heavy duty vent cap system, ranging from vertical to horizontal.

20 Claims, 4 Drawing Sheets

HEAVY DUTY VENT CAP SYSTEM FOR A SUCTION PILE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to anchors for off-shore facilities, such as drilling rigs. More particularly, the present invention relates to a vent cap system for a suction pile. Even more particularly, the present invention relates to a heavy duty vent cap system with alignment for opening and closing in any orientation and with a verifiable seal.

2. Description of Related Art Including Information Disclosed Under 37 CFR 1.97 and 37 CFR 1.98

A suction pile (also known as a suction caisson, a suction anchor, and a suction bucket) is used to moor a subsea drilling rig to the ocean floor. The suction pile is attached to the ocean floor, and rig structures are anchored to the attached suction pile. The suction pile is comprised of a generally tubular body, dropped into the water and floated down to the ocean floor. The open end of the tubular body embeds into the ocean floor, like an upside down bucket faced down in the soil. There is a closed end of the tubular body with a vent hatch. The vent hatch has an opened position and a closed position, and a remote operated vehicle (ROV) is used to move the vent hatch between these two positions. The opened position is used during deployment to the ocean floor, with water flowing through the tubular body by the vent hatch. Once landed, tubular body self-embeds into the ocean floor by sheer weight and momentum upon reaching the ocean floor. The suction pile is partially embedded when landed. For complete embedding, the closed position is used to seal the suction pile, so that air and water remaining in the tubular body are pumped out. An ROV can attach a hose to a suction port on the tubular body. Soil of the ocean floor is further sucked into the tubular body, solidly embedding the suction pile onto the ocean floor to a desired depth. The ROV removes hose and seals the suction port.

The completely embedded and at least partially filled suction pile forms a solid base for mooring a drilling rig structures. Suction piles as anchoring means for rigs and other oil and gas exploration installations are known. The suction pile may also function as a foundation for manifolds. A manifold can be set on top of the suction pile or a plurality of suction piles. Thus, the manifold is installed in a subsea location for access to multiple wells. The manifold on the suction pile can maintain multiple production flowline headers at a subsea location. For the suction pile as an anchor for a rig or foundation for a manifold, the vent hatch remains closed and sealed on the suction pile.

Variations of suction piles are known in the prior art. For example, United States Patent Publication No. 20060127187, published for Raines on Jun. 15, 2006, discloses a conventional anchor system with a variation on the suction pile structure. There is an elongated hollow anchor element releasably attached to an installation element.

The use of ROV technology to facilitate the embedding of a suction pile is also well known. United States Patent Publication No. 20090297276, published for Foo et al., on Dec. 3, 2009 discloses installation using the ROV instead of an aiming mechanism on the anchoring element of the suction pile. U.S. Pat. No. 6,719,496, issued to Eberstein on Apr. 13, 2004, also describes a system with ROV intervention to install a suction pile. The ROV with pump capability closes the flood valves on the top of the suction pile and attaches to the pumping port of the suction pile. The pump of the ROV operates to draw down the suction pile. The ROV disconnects from the pump port and connects a mooring line to second the load connection.

Variations of the vent hatch or vent cap of the suction pile are also known in the prior art. The primary type of vent hatch for a suction pile is the hinged cap. United States Patent Publication No. 20130220206, published for Mogedal et al on Aug. 29, 2013, shows a vent cap as a hinged cap with a frame to insure alignment of the cap plate over the hatch. Another type of vent hatch is the butterfly valve, shown in U.S. Pat. No. 6,719,496, issued to Eberstein on Apr. 13, 2004, with a cap plate swiveling over the hatch for opening and closure. Some vent hatches are combinations of the hinged cap and the butterfly valves, such as U.S. Pat. No. 6,322,439, issued to David on Nov. 27, 2001. The hinge elements transition between the traditional flipping hinged cap with the cap plate lifted from the hatch and the traditional butterfly vent cap with the cap plate swiveling over the hatch.

It is an object of the present invention to provide an embodiment of a heavy duty vent cap system for a suction pile to withstand greater pressures.

It is an object of the present invention to provide an embodiment of a heavy duty vent cap system for a suction pile to distribute load from a center of the bottom plate.

It is an object of the present invention to provide an embodiment of a heavy duty vent cap system for a suction pile with an easier installation.

It is another object of the present invention to provide an embodiment of a heavy duty vent cap, moveable between a closed position and an opened position by an ROV.

It is still another object of the present invention to provide an embodiment of a heavy duty vent cap being actuated between the closed position and the opened position in both a horizontal orientation and a vertical orientation.

It is still another object of the present invention to provide an embodiment of a heavy duty vent cap with alignment of the plate to seal the vent hole in any orientation.

It is yet another object of the present invention to provide an embodiment of a heavy duty vent cap with a stabilized bottom plate for improved seals and installation.

It is yet another object of the present invention to provide an embodiment of a heavy duty vent cap with a means for verifying the seal of the vent hole.

It is yet another object of the present invention to provide an embodiment of a heavy duty vent cap with replaceable parts.

It is yet another object of the present invention to provide an embodiment of a vent cap to fit height requirements for installations.

These and other objects and advantages of the present invention will become apparent from a reading of the attached specification and appended claims.

SUMMARY OF THE INVENTION

Embodiments of the heavy duty vent cap system of the present invention include a top plate with a bucket interface means, a center stem assembly, a retainer assembly, a bottom plate with a stem sleeve and guiding means, an adapter ring, a plurality of perimeter stem assemblies and a plurality of perimeter installation stems. The heavy duty system withstands greater pressure and forces and can be constructed in bigger dimensions than other vent cap systems. The present invention has guiding means to prevent buckling and cocking of the larger bottom plate. Furthermore, the overall height of the vent cap system can be reduced, even as the width dimensions can be increased. Reduced height meets standards for installation on a suction pile.

In some embodiments, the top plate has a bucket interface means centered and extended through the top plate. The bucket interface means is a known interface for remote operated vehicle (ROV) appendages. In some versions, the bucket interface comprises a receptacle fixedly attached to the top plate and receptacle hole. The top plate can also include installation bolts for maneuvering vent cap system to the suction pile, during installation on the suction pile.

A center stem assembly of the present invention can be comprised of a center stem member, a means for engaging said bucket interface means, and a threaded portion in some embodiment. The means for engaging can be a bearing stem on the upper end of the center stem member. The threaded portion is below the means for engaging and can be on the lower end of the center stem member. The ROV can engage bearing stem through the bucket interface means to rotate the center stem member in the center stem assembly. In some embodiments, the means for engaging has a tapered shoulder surface to distribute load away from center of top plate. Other embodiments may further include a top push cone means to engage the tapered shoulder surface. The top push cone means can be a generally frustoconical plate affixed to a bottom side of the top plate.

Embodiments of the heavy duty vent cap system include the retainer assembly being comprised of a nut retaining means, the stem nut housed in the nut retaining means, and a bottom push cone means. The stem nut engages the threaded portion of the center stem assembly and rotates within the nut retaining means, which can be a housing fixed in position adjacent to the bottom push cone means. The rotation along threads of the stem nut held within the retainer assembly actuates the bottom plate between opened and closed positions. The bottom plate does not rotate. The stem nut pushed down or pushes up on the nut retaining means to move the bottom plate. The bottom push cone means can be another generally frustoconical plate, alternatively affixed to the bottom plate to distribute load away from center of bottom plate.

The bottom plate of embodiments of the present invention maintains alignment to the top plate and adapter ring and resists cocking and distortion. The bottom plate comprises a stem sleeve, a guide means, and a sealing means. The stem sleeve is centered on a bottom surface of the bottom plate with the center stem member being partially housed within the stem sleeve. As such, the center stem member is aligned so as to be removably inserted into the stem sleeve, which maintains alignment of the bottom plate and the adapter ring. Embodiments of the guide means are additional plates mounted on a perimeter of a top surface of the bottom plate so as to further support alignment and position of the bottom plate relative to the adapter ring and the top plate. The bottom plate seals to a connection portion of the adapter ring in any orientation of the heavy duty vent cap system, ranging from vertical to horizontal. The welded portion of the adapter ring is fixedly attached to the suction pile. The height of the center stem member is no longer dependent upon the distance traveled by the bottom plate along the center stem member. The stem sleeve protects and seals the center stem member at a shorter length, as consequently less height of the overall system can be achieved.

Embodiments of the heavy duty vent cap system further include perimeter stem assemblies and perimeter installation stems. The perimeter stem assemblies maintain position of said top plate relative to said connection portion during raising and lowering of said bottom plate between an opened position and a closed position. The perimeter installation stems fixedly attach the connection portion to the welded portion, after attachment of said welded portion to the suction pile. The perimeter installation stems also maintain alignment of the bottom plate to the adapter ring and top plate.

The present invention also includes embodiments of a method of forming a suction pile assembly with a heavy duty vent cap system. The suction pile assembly is comprised of a generally cylindrical body with a top pile surface with vent holes on a closed end and a skirt on an opened end. At least one vent hole on a top pile surface with the vent cap system is covered by permanent installation of the welded portion of the adapter ring. The welded portion is made integral with the cylindrical body, and the connection portion of the adapter ring, and the top and bottom plates of the vent cap system are aligned for sealed engagement between the bottom plate and the connection portion. Perimeter installation stems engage the connection portion to the welded portion through the top plate.

The threaded portion center stem assembly is actuated by an ROV through the bucket interface means between an opened position and a closed position of the vent cap system according status of installation of the cylindrical body on the ocean floor. After the suction pile is completely embedded, the vent cap system can remain closed and sealed. The suction pile can be used as an anchor or foundation for off-shore and subsea installations. In cases of failure to seal, the top plate, center stem assembly, retainer assembly, bottom plate, perimeter stem assemblies, perimeter installation stems, and connection portion of the adapter ring can be separated from the welded portion of the adapter ring on the suction pile. A new vent cap system with a different bottom plate and without a welded portion or an emergency cover can be used to seal in the completely embedded stage, when the seal is not important for pumping. In cases of failure to seal before pumping, a new vent cap system with a different bottom plate and without a welded portion can be used, and the seal of the different bottom plate will require verification and testing before the pumping activity.

DETAILED DESCRIPTION OF THE DRAWINGS

Figure 1:
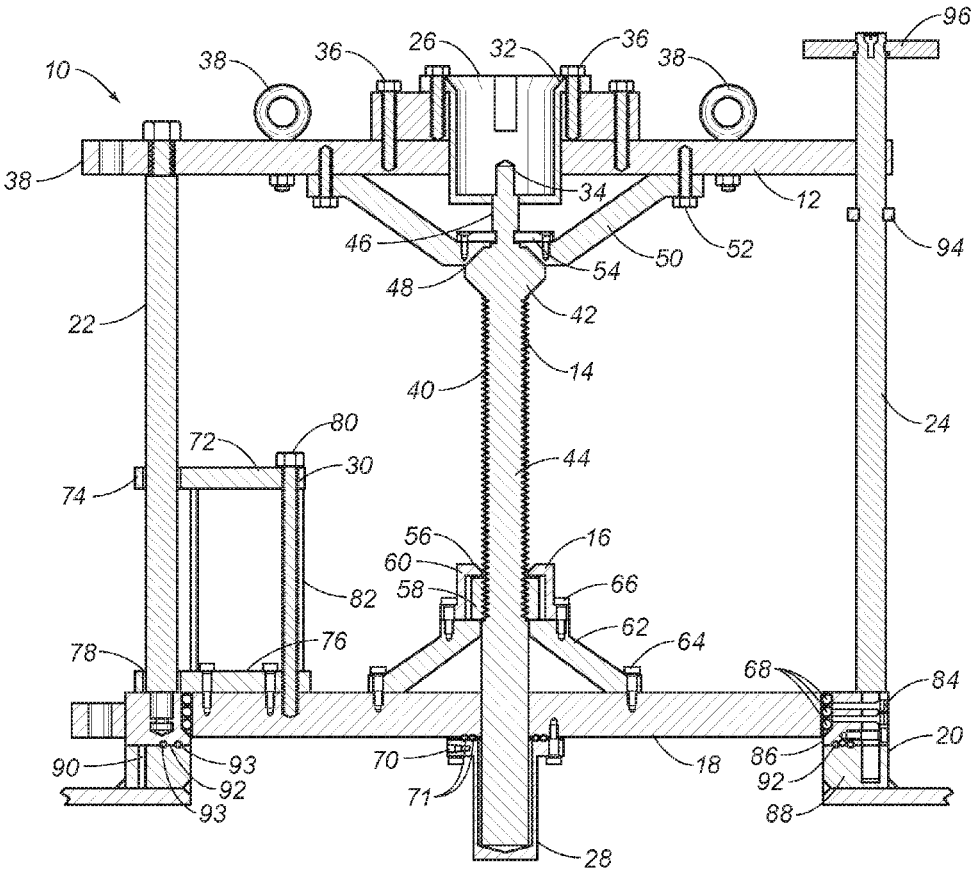
FIG. 1 is a sectional view of an embodiment of the vent cap system of the present invention, showing a closed position.

Referring to FIGS. 1-5, embodiments of the heavy duty vent cap system 10 of the present invention include a top plate 12 with a bucket interface means 26, a center stem assembly 14, a retainer assembly 16, a bottom plate 18 with a stem sleeve 28 and guiding means 30, an adapter ring 20, a plurality of perimeter stem assemblies 22 and a plurality of perimeter installation stems 24. The heavy duty system maintains alignment of the bottom plate 18 during movement between closed and opened positions in any orientation of the system 10 on the suction pile. The heavy bottom plate 18 can reliably seal to the adapter ring 20 whether the suction pile is oriented horizontally or vertically. The system 10 keeps the alignment, even when the structures are constructed of more robust materials. The heavy duty system withstands greater pressure and forces and can be constructed in bigger dimensions than other vent cap systems. The system 10 has an additional guiding means 30 above the bottom plate 18 to prevent buckling and cocking of the larger bottom plate. Furthermore, the overall height of the vent cap system 10 can be reduced, even as the width dimensions can be increased. The guiding means 30 are now above the bottom plate 18, and the center stem assembly 14 is more efficiently housed between the top plate 12 and the adapter ring 20.

In some embodiments, the top plate 12 has a bucket interface means 26 centered and extended through the top plate 12. The bucket interface means 26 is a known interface for a remote operated vehicle (ROV). The handles and grips of the bucket interface means 26 are conventional structures. FIGS. 1-5 show the bucket interface means 26 as a receptacle 32 fixedly attached to the top plate 12 and receptacle hole 34. The receptacle 32 extends through the top plate 12 so that the receptacle hole 34 is below the top plate 12. Screws 36 can attach the receptacle 32 to the top plate 12. FIGS. 1-5 also showing the top plate 12 having installation bolts 38 for maneuvering vent cap system 10 to the suction pile, during installation on the suction pile. Conventional lifting eyes mounted within the top plate 12 can be the installation bolts 38.

Embodiments of the center stem assembly 14 comprise of a center stem member 40, a means for engaging 42 the bucket interface means 26, and a threaded portion 44. The upper end of the center stem member 40 has the means for engaging 42, and the threaded portion 44 is positioned below the means for engaging 26. In FIG. 1, the threaded 44 portion is shown on a lower end of the center stem member 40.

FIG. 1 shows the means for engaging 26 the bucket interface means 26 comprising a bearing stem 46 with a tapered shoulder surface 48. The bearing stem 46 extends through the bucket interface means 26 through a receptacle hole 34. The tapered shoulder surface 48 distribute load away from center of top plate 12. The top plate 12 can withstand greater pressure and load and resists buckling.

The embodiment of FIG. 1 shows the system 10 further comprising a top push cone means 50. The top push cone means 50 is an attachment to further distribute load from the center of the top plate 12. FIG. 1 shows the top push cone means 50 as a generally frustoconical plate affixed to a bottom side of the top plate 12. Threaded screws 52 affix the top push cone means 50 to the top plate 12. Further anchors 54 hold the top push cone means 50 relative to the center stem assembly 14. The tapered shoulder surface 48 is cooperative with the top push cone means for the load distribution. The top push cone means 50 can engage the tapered shoulder surface 48.

FIGS. 1-5 show the retainer assembly 16 being comprised of a nut retaining means 56 and a stem nut 58 housed in the nut retaining means 56. The stem nut 58 threadedly engages the threaded portion 44 of the center stem assembly 14 and rotates within the nut retaining means 56. The nut retaining means 56 fixes the position of the stem nut 58 and the bottom plate 18. When the stem nut 58 moves relative to the center stem assembly 14, the bottom plate 18 moves relative to the center stem assembly 14. The stem nut 58 can exert force against the bottom plate 18. The threaded engagement controls the movement upward and downward along the center stem assembly 14. The stem nut 58 rotates, but the bottom plate 18 does not rotate. The bottom plate only actuates upward and downward along the center stem assembly 14.

An embodiment of the nut retaining means 56 is shown in FIG. 1 as a housing 60. The housing 60 holds the position of the stem nut 58. FIG. 1 also shows the retainer assembly 16, further comprising a bottom push cone means 62. The bottom push cone means 62 is another generally frustoconical plate affixed to a top surface of the bottom plate 18. In this embodiment, the housing 60 is fixed in position adjacent to the bottom push cone means 62 by screws 66, and the bottom push cone means 62 is in fixed engagement to the bottom plate 18. Screws 64 or welding can make the fixed attachment of this embodiment with a bottom push cone means 62. Both the top and bottom push cone means 50, 62 are parts of possible embodiments of the present invention.

FIGS. 1-5 show the bottom plate 18 being comprised of the stem sleeve 28, a guide means 30, and a sealing means 68. The stem sleeve 28 is centered on a bottom surface of the bottom plate 18, which guides the center stem member 40 and aligns the bottom plate 18 to the adapter ring 20 in any orientation. The center stem member 40 is partially housed within the stem sleeve 28 and removably inserted in and out and up and down within the stem sleeve 28 to insure alignment, as the bottom plate 18 raises and lowers. The position of the stem nut 58 in a fixed position above the bottom plate 18 reduces the height of the system 10. The center stem member 40 does not need to extend as far below the bottom plate 18 to maintain alignment. The stem sleeve 28 aligns as a frame assembly below the bottom plate 18. There can also be a test port 70 between the stem sleeve 28 and the bottom plate 18 so as to determine sealing engagement of the stem sleeve 28 and the bottom plate 18. The test port 70 is placed between two O rings, sealing the stem sleeve 28 to the bottom plate 18. The test port 70 is placed between the two O rings 71 for ensuring the seal by both rings 71 on the stem sleeve 28 and the bottom plate 18. In embodiments of the present invention, the length of the center stem member 40 is no longer related to the amount of movement of the bottom plate 18 along the center stem member 40. The stem nut 58 rotates up and down the center stem member 40 to move the bottom plate 18. The stem sleeve 28 protects the center stem member 40 and supports alignment, as the guide means 30 set the orientation of the bottom plate 18. The length of the stem sleeve 28 and the height of the stem nut 58 above the bottom plate 18 determine the overall height of the system 10. The vertical movement of the bottom plate 18 ranges from the tip of the central stem member 40 at the tip of the stem sleeve 28 to the tip of the central stem member 40 at the stem nut 58. The system 10 has the guide means 30 to support the alignment of the bottom plate 18, not just the center stem member 40. The support of the bottom plate 18 is not only the center mounted structures, as in the prior art.

Embodiments of the system 10 have the guide means 30 mounted on a perimeter of a top surface of the bottom plate 18 so as to maintain position of the bottom plate 18 relative to the adapter ring 20. The embodiment of the guide means 30 in FIGS. 1-5 is only one embodiment. Other conventional structures and plates are within the present invention. However, the guide means 30 should be located above the bottom plate 18 in the present invention. The embodiment of FIGS. 1-5 show the guide means 30 comprising an upper guide plate 72 with an upper guide hole 74, a lower guide plate 76 with a lower guide hole 78, and a plurality of guide bolts 80. The lower guide plate 76 is in fixed engagement to the top surface of the bottom plate 18, and the plurality of guide bolts 80 fixedly attach the upper guide plate 72 to the lower guide plate 74 and to the top surface of the bottom plate 18. FIGS. 1-5 show the perimeter stem assembly 22 inserted through the upper guide hole 74 and the lower guide hole 78. The guide means 30 maintains alignment of the bottom plate 18 to the adapter ring 20, resists cocking of the bottom plate 18, and supports load from greater pressures of a heavy duty vent cap system 10. The bottom plate 18 raises and lowers as the perimeter stem assembly 22 slides through the upper and lower guide plates 72 and 76. In other embodiments, there can be a tubular member 82 mounted between the upper guide plate 72 and the lower guide plate 76, covering the plurality of guide bolts 80. The tubular member 82 can contribute stiffness for additional guidance of the bottom plate 18.

FIGS. 1-5 also shows the sealing means 68 of the bottom plate 18 positioned on an outer circumference of the bottom plate 18. There can be a test port 84 between the sealing means 68 of the bottom plate 18 and the adapter ring 20 so as to determine sealing engagement of the bottom plate 18 and the adapter ring 20. The sealing means 68 may be comprised of an O-ring seal. The test port 84 can be positioned adjacent the O-ring seal on either side of the seal or between sealing means 68 of a plurality of O-ring seals. The test port 84 confirms the seal between the bottom plate 18 and the adapter ring 20.

Figure 2:
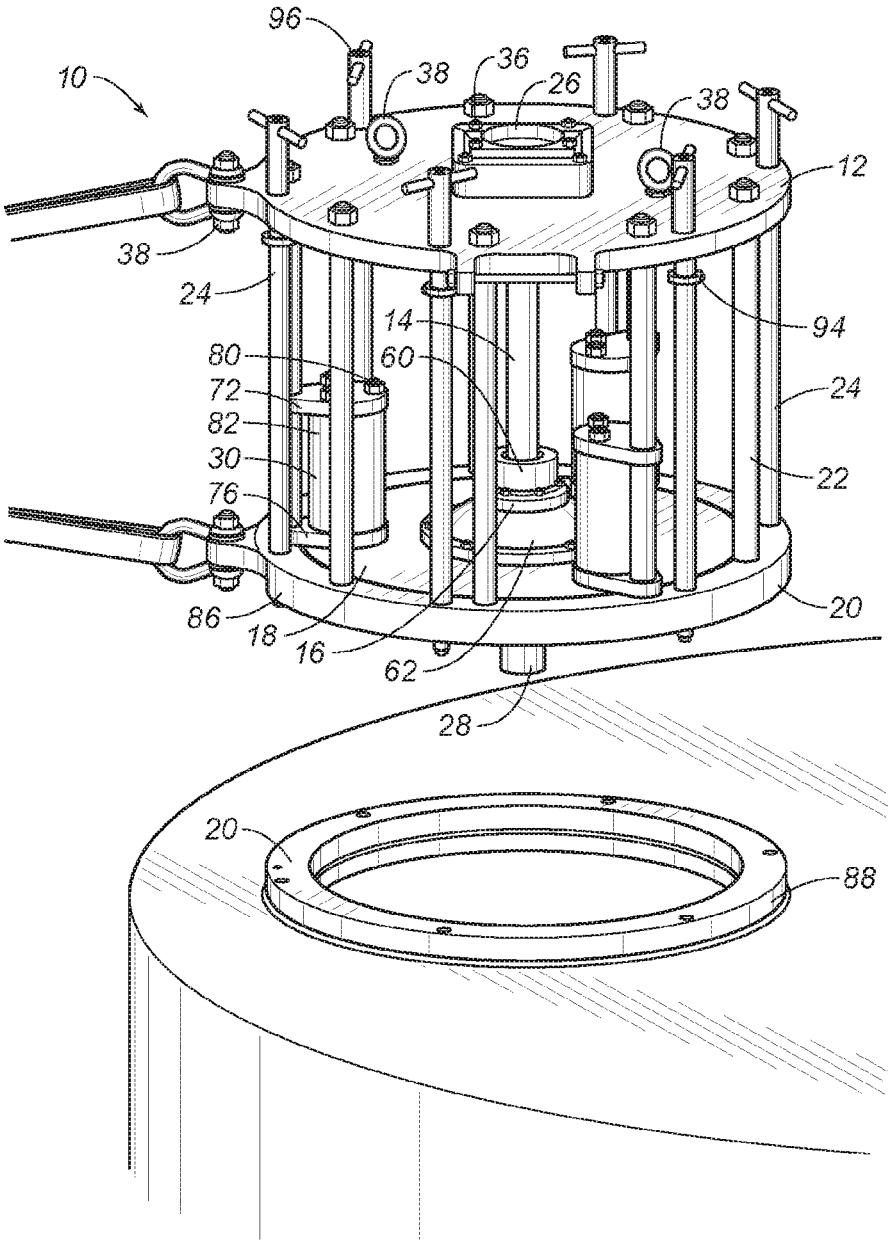
FIG. 2 is an upper perspective view of an embodiment of the vent cap system of the present invention, showing installation and alignment in a horizontal orientation.
Figure 3:
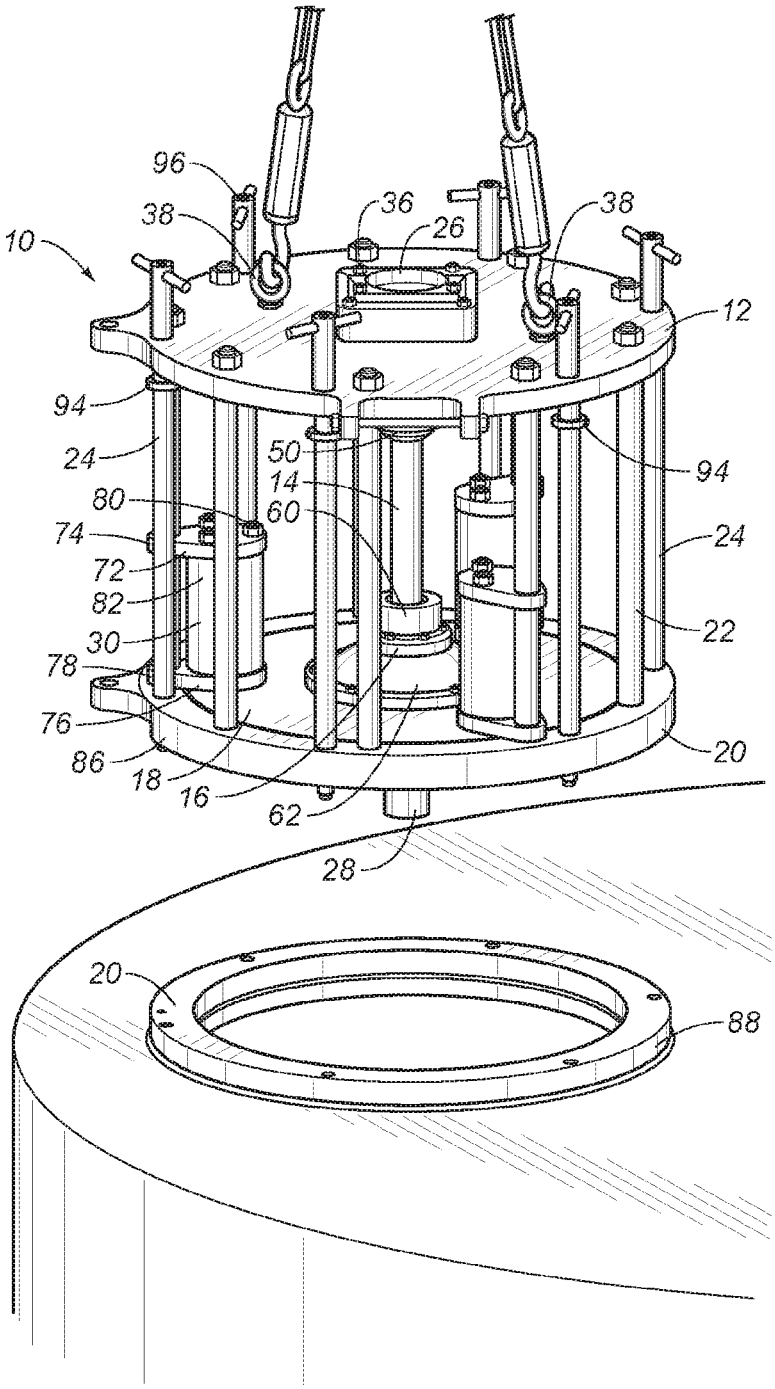
FIG. 3 is an upper perspective view of an embodiment of the vent cap system of the present invention, showing installation and alignment in a vertical orientation.

Embodiments of the system 10 of the present invention show the adapter ring 20 having a welded portion 88 and a connection portion 86. The welded portion 88 is permanently attached to the suction pile as shown in FIGS. 2 and 3. The welded portion 88 is separable from the connection portion 86. It can be necessary to separate the welded portion 88 during installation and assembly of the system 10. It can also be easier and more convenient to separate the welded portion 88 for the operations needed to weld, to screwing attach, or otherwise permanently attach the welded portion 88 to the suction pile. FIG. 1 shows an additional test port 90 between the welded portion 88 of the adapter ring 20 and a suction pile so as to determine sealing engagement of the adapter ring 20 and the suction pile. FIGS. 1-5 show the connection portion 86 facing the bottom plate 18 and removably engaging the bottom plate 18. There is removable sealed engagement to between the connection portion 86 and the bottom plate 18, which can be detected at the test port 84.

Each perimeter stem assembly 22 is arranged on a perimeter of the connection portion 86 of the adapter ring 20 so as to maintain position of the top plate 12 relative to the connection portion 86 during raising and lowering of the bottom plate 18 between the opened position and the closed position. The perimeter stem assembly 22 also anchors the guide means 30 in alignment.

Figure 4:
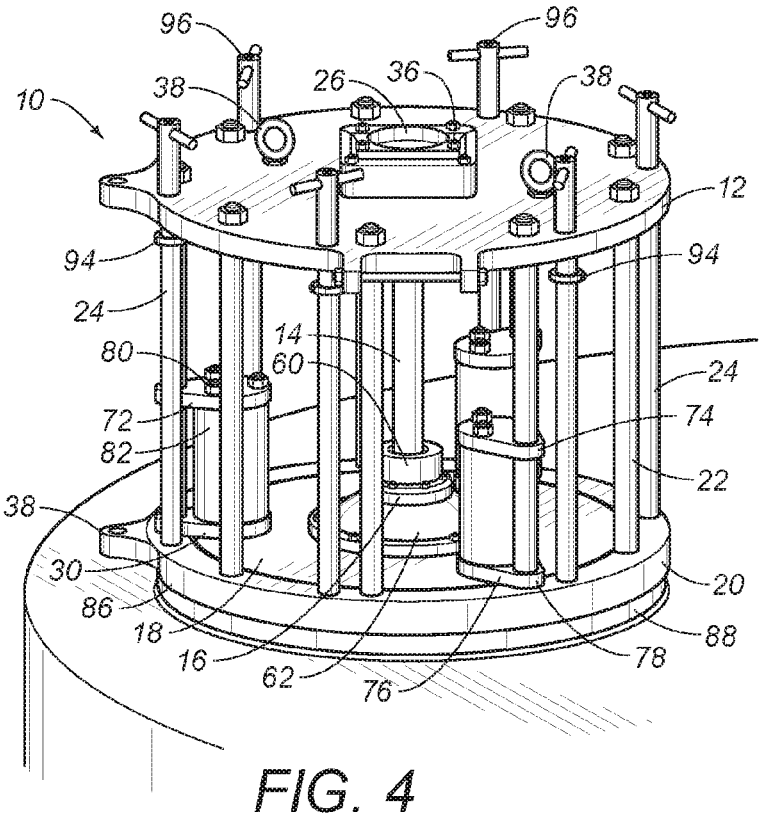
FIG. 4 is a perspective view of an embodiment of the vent cap system of the present invention, showing an assembled configuration on a suction pile in a vertical orientation and closed position.
Figure 5:
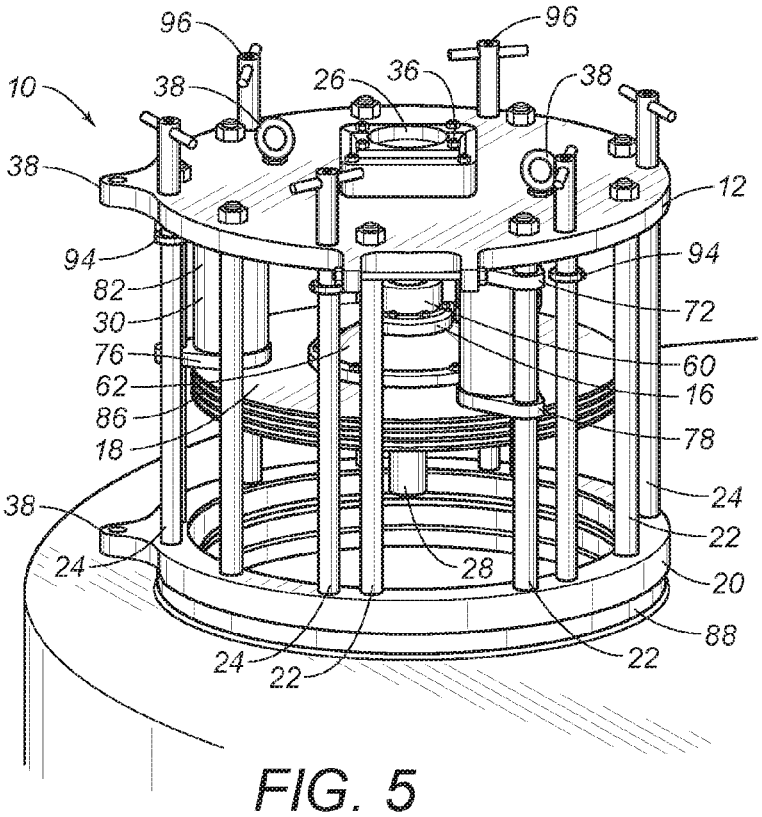
FIG. 5 is another perspective view of an embodiment of the vent cap system of the present invention, showing an assembled configuration on a suction pile in a vertical orientation and opened position.

Each perimeter installation stem 24 is also arranged on the perimeter of the connection portion 86 of the adapter ring 20. The perimeter installation stem 24 fixedly attach the connection portion 86 to the welded portion 88 after attachment of the welded portion 88 to the suction pile. FIGS. 2-3 show the installation process, and FIGS. 1, 4 and 5 show the assembled connection portion 86 to the welded portion 88. Each perimeter installation stem 24 extends through the top plate 12 and through the connection portion 86 to engage the welded portion 88. There can additional seal rings and test ports 92 to detect the seal between the connection portion 86 and the welded portion 88. The test port 92 is placed between two O rings 93, sealing the connection portion 86 to the welded portion 88. The test port 92 is placed between the two O rings 93 for ensuring the seal by both rings 93 on the connection portion 86 and the welded portion 88.

At least one perimeter installation stem 24 can have a shaft clamp 94 mounted between the top plate 12 and the connection portion 86, as shown in FIGS. 1-5. The shaft clamp 94 prevents the perimeter installation stem 24 from slipping out of the top plate 12 and out of the system 10. At least one perimeter installation stem 24 can also have a gripping member 96 above the top plate 12. The gripping member 96 can be a conventional structure, such as a handle, which can be engaged by the ROV. The ROV can separate of connection portion 86 from welded portion 88, if necessary.

The present invention includes the method of forming a suction pile assembly with a vent cap system 10 of FIGS. 1-5. The suction pile assembly is comprised of a generally cylindrical body with a pile surface with vent holes on a closed end and a skirt on an opened end. The suction pile assembly is formed before deployment to the sea floor. The method includes covering a vent hole on a pile surface with the welded portion of the adapter ring of the vent cap system, attaching the connection portion of the adapter ring to the welded portion, actuating the center stem member in threaded engagement to the stem nut, and moving the bottom plate between an opened position and a closed position. The welded portion of the adapter ring is placed on the suction pile in alignment with the vent hole. The welded portion can be welded or otherwise permanently attached to the suction pile. For attaching the connection portion, at least one perimeter installation stem through the top plate and the connect portion engages the welded portion to seal the connection portion to the welded portion. The vent cap system remains in alignment along the center stem assembly according status of installation of the cylindrical body. The orientation of the suction pile from horizontal to vertical does not affect the alignment, so that the seal between the bottom plate and the adapter ring remains consistent and reliable.

Embodiments of the method include the step of distributing load away from center of the top plate. The valve system can use a tapered shoulder surface, or a top push cone or both. Another embodiment includes the step of distributing load away from center of the bottom plate. The valve system can use a bottom push cone affixed to a top surface of the bottom plate.

Further embodiments of the method include the step of maintaining alignment and position of the bottom plate during the step of moving the bottom plate with the guide means comprised of an upper guide plate with an upper guide hole, a lower guide plate with a lower guide hole, and a plurality of guide bolts, lower guide plate in fixed engagement to the top surface of the bottom plate, the plurality of guide bolts fixedly attaching the upper guide plate to the lower guide plate and to the top surface of the bottom plate. The perimeter stem assembly inserts through the upper guide hole and the lower guide hole of the guide plates to maintain alignment of the upper guide plate and the lower guide plate with the bottom plate.

Embodiments of the present invention provide a vent cap system for a suction pile. The vent cap system has a closed position and an opened position, and an ROV can facilitate the transition between the closed position and the opened position. In the prior art, orientation of the suction pile affected the ability to open and close the vent hatch or vent cap. For a hinged cap, the horizontal orientation required the ROV to lift the cap into the closed position. The procedure required excess power and skill to manipulate the ROV under those conditions. An angle orientation causes more complicated maneuvers by the ROV for closing at an angle. The present invention can be actuated between the closed position and the opened position in both a horizontal orientation and a vertical orientation. Additionally, the same rotation of the threaded center stem bolt body opens and closes the vent cap system in both orientations and in other angled orientations. The ROV can more easily open and close the vent cap system without regard to orientation or additional power and skill requirements. The handling of the ROV is much easier with the structures and interfaces of the eye nuts and simple handles for the center stem assembly and perimeter stem assemblies.

For greater pressures and higher loads, the vent cap system must account for the more robust materials and size constraints. For larger suction piles, the system cannot be too much wider because the bottom plate would be subject to buckling or cocking. Such high pressures required a sturdier arrangement and support of the bottom plate. The bottom plate with the stem sleeve and fixed position of the nut retaining means relative to the bottom plate reduced the height of the system. The vertical movement of the bottom plate no longer defines the height of the system. The stem sleeve and distance of the stem nut above the bottom plate cover the range of movement of the bottom place. With the stem nut above the bottom plate, the overall height of the system can be reduced. The guide means add more support to prevent distortion and buckling of the bottom plate, while continuing to maintain alignment of the bottom plate and adapter ring in any orientation. The center stem member is no longer relied upon for the support and guidance of the bottom plate. Under the more extreme conditions, the present invention further discloses a system to distribute load from a center of the bottom plate and from a center of the top plate. The vertical load is not so concentrated on the center stem assembly and center of the plates. A tapered shoulder surface and push cones can distribute more evenly.

The present invention also simplifies the installation on the suction pile with a more simple welded portion of the adapter ring. The welded portion is more easily separated and re-connected to the connection portion for assembly.

The prior art also lacked means for testing the seal to be sufficient to withstand the necessary pressure for pumping out water and suctioning soil into the suction pile. The prior art butterfly valve has reliability problems with establishing and maintaining a proper seal. The complete closure of the butterfly valve could not be confirmed because the position of the flap of the bottom plate would be so variable. The placement of a testing port may be above or below the pivoting flap of a butterfly valve. In the present invention, the alignment of the bottom plate is assured with the center stem assembly and stem sleeve. There is alignment of the bottom plate in any orientation of the vent cap system, including horizontal, vertical or angled orientations. The center stem member and stem sleeve control the consistency of the seal of the bottom plate to the flange assembly in any orientation and allows for testing the seals to verify the sufficiency of pressure to fully install the suction pile on the ocean floor. There are additional various test ports to detect and confirm seals between the bottom plate and the adapter ring, the welded portion to the suction pile, the stem sleeve to the bottom plate, and the connection portion to the welded portion. Additionally, the bottom alignment pin assures.

The present invention is also able to adjust for failures to close and seal. The welded portion is detachable from the connection portion and remaining structures during installation on a suction pile. If the bottom plate does not close, then the bottom place can be replaced. An emergency cover can be attached. A replacement bottom plate can also be delivered on a partial vent cap system without a welded portion. In some cases, an emergency cap will be sufficient to close the suction pile, if completely embedded. In other cases, an emergency cap will not withstand the required pressure for the suction of the pump to complete the embedding process, so the vent cap system of the present invention provides a replacement system for a different bottom plate to re-close and re-seal and test the re-sealed suction pile. The bottom plate, and other parts, can be replaceable.

The foregoing disclosure and description of the invention is illustrative and explanatory thereof. Various changes in the details of the described method can be made without departing from the true spirit of the invention.

I claim:

1. A vent cap system, comprising:

a top plate having a bucket interface means centered on said top plate;

a center stem assembly being comprised of a center stem member, a means for engaging said bucket interface means, and a threaded portion, said means for engaging being positioned on an upper end of said center stem member, said threaded portion being positioned below said means for engaging;

retainer assembly being comprised of a nut retaining means and a stem nut housed in said nut retaining means, said stem nut being in threaded engagement to said threaded portion of said center stem assembly, said stem nut being rotatable within said nut retaining means;

a bottom plate being comprised of a stem sleeve, a guide means, and a sealing means, said stem sleeve being centered on a bottom surface of said bottom plate, said center stem member being partially housed within said stem sleeve, said center stem member being aligned so as to be removably inserted into said stem sleeve, said nut retaining means being in fixed engagement to said bottom plate, wherein said stem nut exerts force against said bottom plate so as to actuate said bottom plate, and wherein said sealing means is positioned on an outer circumference of said bottom plate;

an adapter ring having a welded portion and a connection portion, said welded portion for permanent attachment to the suction pile, said connection portion facing said bottom plate and removably engaging said bottom plate, said bottom plate in removable sealed engagement to said connection portion, wherein said guide means mounts on a perimeter of a top surface of said bottom plate so as to maintain position of said bottom plate relative to said top plate;

a plurality of perimeter stem assemblies, each perimeter stem assembly being arranged on a perimeter of said connection portion of said adapter ring so as to maintain position of said top plate relative to said connection portion during raising and lowering of said bottom plate between an opened position and a closed position; and a plurality of perimeter installation stems, each perimeter installation stem being arranged on said perimeter of said connection portion of said adapter ring so as to fixedly attach said connection portion to said welded portion after attachment of said welded portion to the suction pile, each perimeter installation stem extending through said top plate and through said connection portion to engage said welded portion.

2. The vent cap system, according to claim 1, wherein said bucket interface means comprises a receptacle fixedly attached to said top plate and receptacle hole, said bucket interface means extending through said top plate.

3. The vent cap system, according to claim 1, further comprising installation bolts extending from a top side of said top plate, said installation bolts have connectors on top ends above said top side.

4. The vent cap system, according to claim 1, wherein said means for engaging said bucket interface means comprises a bearing stem with a tapered shoulder surface, said bearing stem extending through said bucket interface means through a receptacle hole.

5. The vent cap system, according to claim 1, further comprising a top push cone means being a generally frustoconical plate affixed to a bottom side of said top plate.

6. The vent cap system, according to claim 5, wherein said means for engaging said bucket interface means comprises a bearing stem with a tapered shoulder surface, and wherein said top push cone means engages said tapered shoulder surface.

7. The vent cap system, according to claim 1, wherein said retainer assembly further comprises a bottom push cone means, said bottom push cone means being a generally frustoconical plate affixed to a top surface of said bottom plate.

8. The vent cap system, according to claim 7, wherein said nut retaining means comprises a housing fixed in position adjacent to said bottom push cone means, said bottom push cone means in fixed engagement to said bottom plate.

9. The vent cap system, according to claim 1, further comprising a test port between said stem sleeve and said bottom plate so as to determine sealing engagement of said stem sleeve and said bottom plate.

10. The vent cap system, according to claim 1, wherein said guide means comprises an upper guide plate with an upper guide hole, a lower guide plate with a lower guide hole, and a plurality of guide bolts, lower guide plate in fixed engagement to said top surface of said bottom plate, said plurality of guide bolts fixedly attaching said upper guide plate to said lower guide plate and to said top surface of said bottom plate.

11. The vent cap system, according to claim 10, wherein at least one perimeter stem assembly inserts through said upper guide hole and said lower guide hole of the guide plates, supporting alignment of said upper guide plate and said lower guide plate with said bottom plate, during raising and lowering of said bottom plate between said opened position and said closed position.

12. The vent cap system, according to claim 1, further comprising a tubular member mounted between the upper guide plate and the lower guide plate, covering said plurality of guide bolts.

13. The vent cap system, according to claim 1, further comprising a test port between said sealing means of said bottom plate and said connection portion of said adapter ring so as to determine sealing engagement of said bottom plate and said adapter ring.

14. The vent cap system, according to claim 1, wherein distance between an end of said stem sleeve and said stem nut determines range of movement of said bottom plate, and wherein said stem sleeve and position of said stem nut above said bottom plate determines overall height.

15. The vent cap system, according to claim 1, wherein at least one perimeter installation stem has a shaft clamp mounted between said top plate and said connection portion.

16. A method of forming a suction pile assembly with a vent cap system according to claim 1, said suction pile assembly being comprised of a generally cylindrical body with a pile surface with vent holes on a closed end and a skirt on an opened end, said method of forming comprising the steps of:

covering a vent hole on a pile surface with the vent cap system by placement of said welded portion of said adapter ring on said suction pile in alignment with said vent hole;

attaching said connection portion of said adapter ring to said welded portion by engaging at least one perimeter installation stem through said top plate and said connect portion to said welded portion; and actuating said center stem member in threaded engagement to said stem nut; and moving said bottom plate between an opened position and a closed position of the vent cap system in alignment along said center stem assembly according status of installation of the cylindrical body.

17. The method of forming a suction pile assembly, according to claim 16, further comprising the step of distributing load away from center of said top plate, wherein said valve system further comprises a top push cone being a generally frustoconical plate affixed to a bottom side of said top plate.

18. The method of forming a suction pile assembly, according to claim 17, wherein said means for engaging said bucket interface means comprises a bearing stem with a tapered shoulder surface, and wherein said top push cone engages said tapered shoulder surface.

19. The method of forming a suction pile assembly, according to claim 16, further comprising the step of distributing load away from center of said bottom plate, wherein said retainer assembly further comprises a bottom push cone, said bottom push cone being a generally frustoconical plate affixed to a top surface of said bottom plate.

20. The method of forming a suction pile assembly, according to claim 16, further comprising the step of maintaining alignment and position of said bottom plate during the step of moving said bottom plate, wherein said guide means comprises an upper guide plate with an upper guide hole, a lower guide plate with a lower guide hole, and a plurality of guide bolts, lower guide plate in fixed engagement to said top surface of said bottom plate, said plurality of guide bolts fixedly attaching said upper guide plate to said lower guide plate and to said top surface of said bottom plate, and wherein at least one perimeter stem assembly inserts through said upper guide hole and said lower guide hole of the guide plates, supporting alignment of said upper guide plate and said lower guide plate with said bottom plate.

* * * * *